US007811133B2

(12) United States Patent
Gray

(10) Patent No.: US 7,811,133 B2
(45) Date of Patent: Oct. 12, 2010

(54) SHIELDED ELECTRICAL CONNECTOR WITH A SPRING ARRANGEMENT

(75) Inventor: Ian James Stafford Gray, Near Winchester (GB)

(73) Assignee: Fusion Components Limited (GB)

( * ) Notice: Subject to any disclaimer, the term of this patent is extended or adjusted under 35 U.S.C. 154(b) by 0 days.

(21) Appl. No.: 12/471,856

(22) Filed: May 26, 2009

(65) Prior Publication Data

US 2009/0280685 A1 Nov. 12, 2009

(51) Int. Cl.
*H01R 9/03* (2006.01)

(52) U.S. Cl. ..... 439/607.41; 439/584

(58) Field of Classification Search ..... 439/607.41, 439/578, 583, 584, 585
See application file for complete search history.

(56) References Cited

U.S. PATENT DOCUMENTS 3,668,612 A * 6/1972 Nepovim ..... 439/584
3,671,926 A * 6/1972 Nepovim ..... 439/584
4,046,451 A * 9/1977 Juds et al. ..... 439/583
4,156,554 A * 5/1979 Aujla ..... 439/584
5,518,420 A * 5/1996 Pitschi ..... 439/578
5,993,254 A * 11/1999 Pitschi et al. ..... 439/584
6,217,384 B1 * 4/2001 Strasser et al. ..... 439/583
6,267,621 B1 7/2001 Pitschi
7,309,255 B2 * 12/2007 Rodrigues ..... 439/578
7,566,243 B1 * 7/2009 Hung ..... 439/578
2006/0205272 A1 * 9/2006 Rodrigues ..... 439/585

FOREIGN PATENT DOCUMENTS

EP 0798815 A2 10/1997
EP 0901200 A2 3/1999

OTHER PUBLICATIONS

Searh report in GB0808411.3 dated Sep. 3, 2008.

* cited by examiner

*Primary Examiner*—Hae Moon Hyeon

(57) ABSTRACT

A connector for a shielded electrical cable. The cable has at least one insulated central conductor surrounded by conductive shielding. The connector comprises a dielectric spacing element for receiving the at least one central conductor of the cable and a conductive shielding arrangement provided around the spacing element and having a first end which defines an annular surface for contacting the shielding of the cable. The connector further comprises a spring arrangement coupled to the shielding arrangement for resiliently urging the shielding of the cable against the annular surface of the shielding arrangement to thereby provide a reliable electrical connection between the cable and the shielding arrangement.

14 Claims, 2 Drawing Sheets

SHIELDED ELECTRICAL CONNECTOR WITH A SPRING ARRANGEMENT

FIELD OF THE INVENTION

This invention relates to a shielded electrical connector. More particularly, this invention relates to a shielded electrical connector having a means for providing an electrical grounding connection.

BACKGROUND OF THE INVENTION

Shielded electrical connectors are well known. These connectors are used for coupling shielded cables, which are electrical cables in which at least one insulated inner conductor is enclosed by a conductive shielding layer. Where there is a single insulated inner conductor, shielded cables are known as coaxial cables.

Shielded cables are typically used in applications where it is desired to minimise the effect of electrical noise on signals which are being carried in the cables or to reduce the electromagnetic radiation emitted by the cables. The former is particularly important for cables carrying high bandwidth signals which are particularly susceptible to noise. The latter is important for cables carrying high voltages. Shielded cables may be used for carrying analogue or digital signals.

In shielded cables, the shielding is usually in the form of braided strands of copper which surround the inner conductor(s), although other conductive shielding arrangements such as spiral windings of metallic foil and sleeves of conductive polymers are also known. The shielding is usually grounded, although the shielding may in some applications carry signals. In either case, it is important that a shielded electrical connector maintains the shielding and provides a reliable electrical connection for both the inner conductor(s) and the shielding.

In known shielded electrical connectors, such as Bayonet Neill-Concelman connectors, hereinafter referred to as BNC connectors, the shielding connection is provided by a conductive sleeve-like body. The sleeve-like body surrounds a dielectric spacing member, which spacing member accommodates at least one elongate contact pin provided for connecting the inner conductor.

Known shielded electrical connectors are typically coupled to shielded cables by an assembly process in which a crimping tool is used to attach a crimp sleeve to the sleeve-like body of the connector, with the shielding of the cable being trapped between the sleeve-like body and the crimp sleeve. The crimp sleeve serves to provide an electrical connection between the cable shielding and the sleeve-like body of the connector and to mechanically couple the cable to the connector.

A potential problem with shielded electrical connectors of the type described above is that a special tool is required for coupling the connectors to cables, which adds both cost and complexity to the connector assembly process. Moreover, different sized tools are required for different sized cables and connectors. In some applications, crimp tools may need to be periodically calibrated, which may add further considerable expense.

SUMMARY OF THE INVENTION

According to an aspect of the invention, there is provided a connector for a shielded electrical cable, the cable having at least one insulated central conductor surrounded by conductive shielding, the connector comprising:

a dielectric spacing element for receiving the at least one central conductor of the cable;

a conductive shielding arrangement provided around the spacing element and having a first end which defines an annular surface for contacting the shielding of the cable, and a spring arrangement coupled to the shielding arrangement for resiliently urging the shielding of the cable against the annular surface of the shielding arrangement to thereby provide a reliable electrical connection between the cable and the shielding arrangement.

The invention thus provides a shielded connector in which an electrical and/or mechanical connection with the shielding of a cable may be maintained by a spring arrangement. In this way, the need for special tools may be avoided. Moreover, the nature of the spring arrangement may be such that a resilient force is constantly maintained for the service life of the connector, thereby minimising performance degradation over time.

The invention is particularly concerned with the electrical and/or mechanical connection between a shielded connector and the shielding of a cable. Thus, the at least one central conductor of the cable may be dealt with in a conventional manner. For example, at least one elongate contact pin may be arranged within the spacing element for connection to the at least one central conductor. The or each contact pin may be hollow for receiving a respective central conductor of the cable.

Similarly, the end of the connector defined by a second end of the shielding arrangement may be conventional. For example, the second end of the shielding arrangement may comprise a resilient tube-like structure for coupling with a mating connector. The second end of the shielding arrangement may additionally or alternatively be provided with a bayonet or screw cap for mechanically locking the connector to a mating connector. The mating part of the connector may conform to a standard such as the standard for BNC connectors.

The annular surface of the shielding arrangement, which is provided for contacting the shielding of the cable, may comprise a frusto-conical surface. A frusto-conical surface may allow for the spring arrangement to provide sufficient force for a reliable electrical connection. The annular surface of the shielding arrangement may also define an annular groove.

The spring arrangement may comprise a collar for contacting the annular surface of the shielding arrangement such that the shielding of the cable is trapped between the shielding arrangement and the collar. The collar of the spring arrangement is then urged towards the annular surface of the shielding arrangement to ensure good electrical contact between the shielding arrangement and the shielding of the cable. The collar may be formed of a metallic material having a low electrical resistance.

The collar may defines a frusto-conical surface arranged to engage with a frusto-conical surface of the shielding arrangement. Additionally, the collar may defines an annular projection arranged to engage with (i.e. be received by) the annular groove of the shielding arrangement. These features may also provide for good electrical connection between the shielding arrangement and the shielding of the cable.

The spring arrangement may further comprise a compression spring for resiliently bearing against the collar. The compression spring may be a coil spring, in which case the at least one inner conductor of the cable is able to be received, unimpeded, into the spacing element of the connector. Spring types other than coil springs may be used, such as one or a plurality of stacked wave springs.

The spring arrangement may further comprise a spring supporting means having a bearing surface for supporting one end of the compression spring such that the other end of the compression spring is able to bear against the collar. The spring supporting means may be reversibly engagable with the shielding arrangement to allow for assembly of the connector onto a cable and such that, once assembled, a positional relationship between the annular surface of the shielding arrangement and the bearing surface of the spring supporting means may be fixed.

The spring supporting means may comprise a sleeve arranged for receiving the compression spring. The sleeve may have inwardly formed flanges at one end defining the bearing surface and inwardly formed protrusions at the other end for engaging with cooperating formations on the outer surface of the shielding arrangement.

The cooperating formations on the outer surface of the shielding arrangement may comprise a raised band having discontinuities of sufficient width to enable the inwardly formed protrusions of the sleeve to pass.

The sleeve may alternatively engage with the shielding arrangement by other locking means, such as bayonet or screw connections.

The invention also provides an arrangement comprising a shielded electrical cable having at least one insulated central conductor surrounded by conductive shielding, wherein the cable is terminated with the connector described above.

BRIEF DESCRIPTION OF THE DRAWINGS

A specific embodiment of the invention will now be described, by way of example only, with reference to the accompanying drawings in which.

DETAILED DESCRIPTION

The invention provides a connector for a shielded electrical cable having at least one insulated central conductor surrounded by conductive shielding. The connector comprises a dielectric spacing element for receiving the at least one central conductor of the cable, and a conductive shielding arrangement provided around the spacing element and having a first end which defines an annular surface for contacting the shielding of the cable. The connector also comprises a spring arrangement coupled to the shielding arrangement for resiliently urging the shielding of the cable against the annular surface of the shielding arrangement to thereby provide a reliable electrical connection between the cable and the shielding arrangement.

Figure 1:
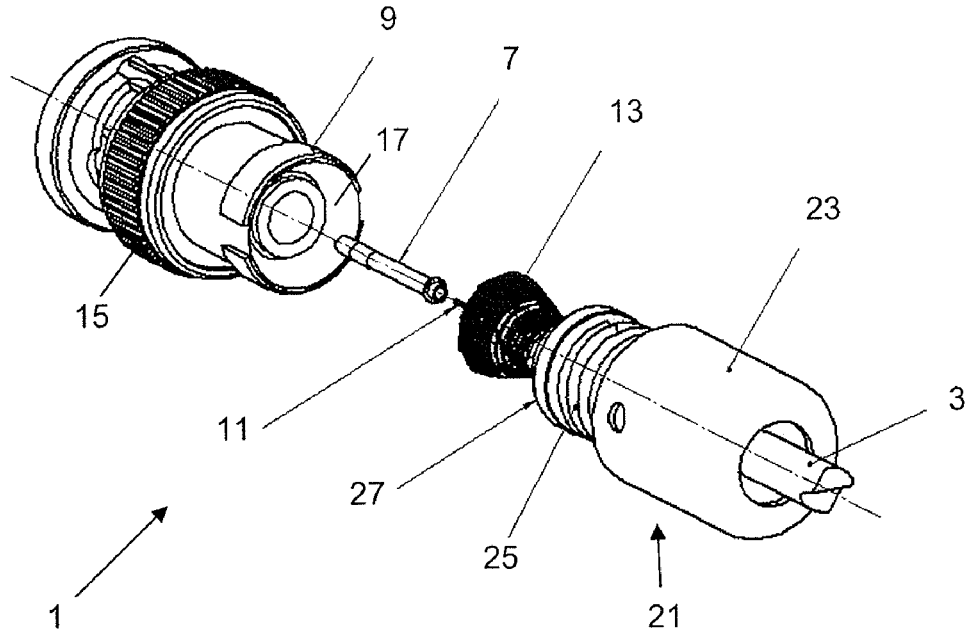
FIG. 1 is a partially exploded view of a connector according to the invention.
Figure 2:
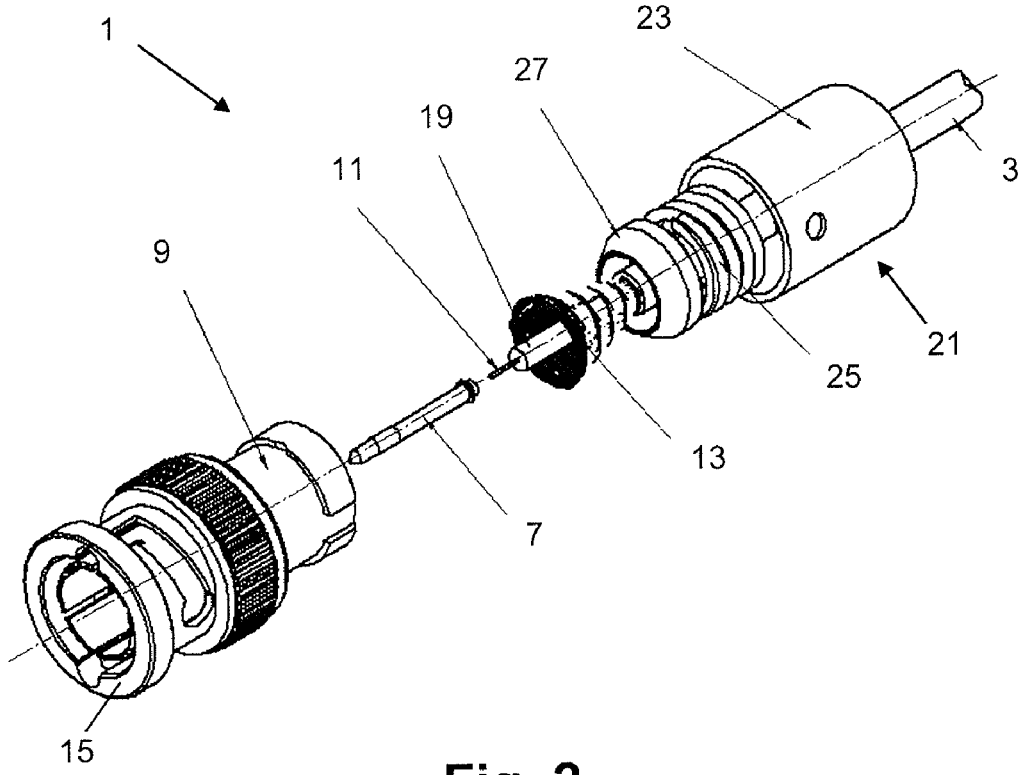
FIG. 2 is a second partially exploded view of the connector shown in FIG. 1.
Figure 3:
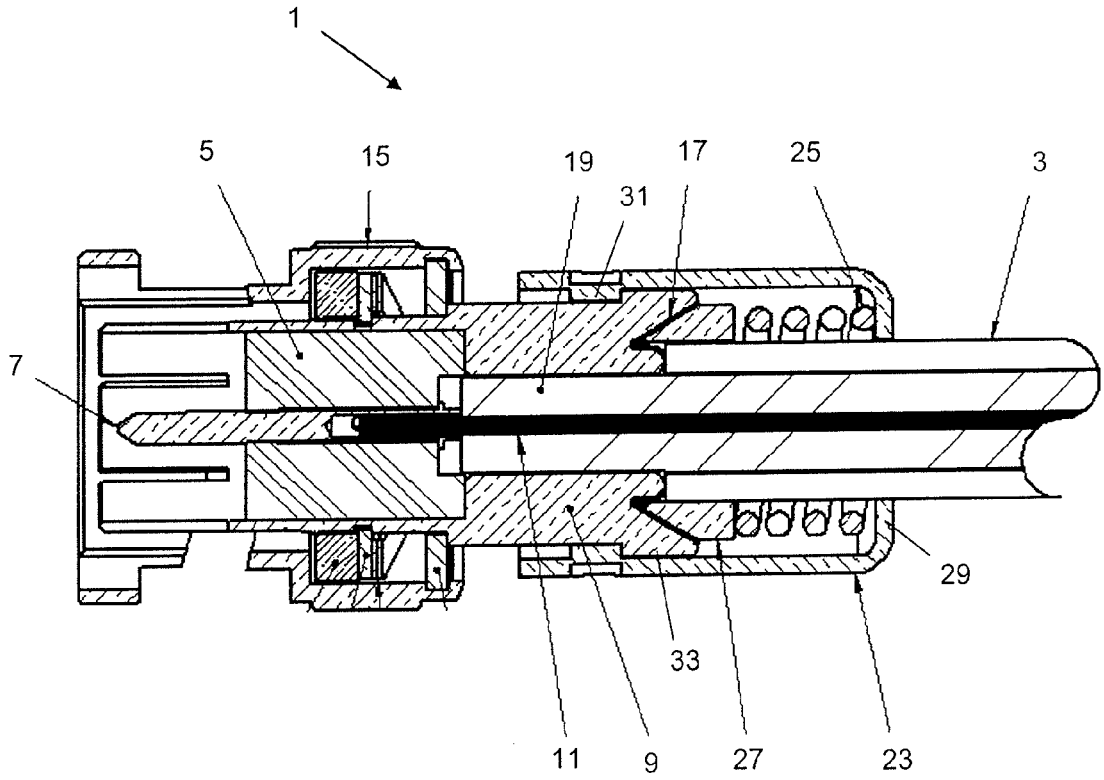
FIG. 3 is a longitudinal cross-sectional view of the connector shown in FIG. 1 assembled onto a shielded cable.

Referring to FIGS. 1, 2 and 3, a shielded connector 1 for a shielded electrical cable 3 comprises a substantially cylindrical dielectric spacing element 5 formed of a plastics material having good electrical insulating properties. The spacing element 5 maintains a physical separation between an elongate contact pin 7 and a shielding arrangement 9, which are each arranged coaxially with the spacing element 5.

The contact pin 7 is formed of a metallic material having a low electrical resistance. The contact pin 7 is arranged to be substantially flush with the spacing element 5 at a first end of the spacing element 5, and a flange may be provided to facilitate accurate positioning in this regard. The contact pin 7 is arranged to protrude from the spacing element 5 at a second end of spacing element 5. The protruding end of the contact pin 7 is adapted for mating with another connector (not shown) and is provided with a pointed surface. The flush end of the contact pin is adapted for receiving a central conductor 11 of the shielded electrical cable 3 and is hollow.

The shielding arrangement 9 of the connector 1 is also formed of a metallic material having a low electrical resistance. As well as electrically shielding the contact pin 7, the shielding arrangement 9 performs a number of other functions.

The shielding arrangement 9 defines the main body of the connector 1. Thus, it is the shielding arrangement 9 which is mechanically coupled to both the cable 3 at the first end and the mating connector (not shown) at the second end. The shielding arrangement 9 also provides an electrical connection between the shielding 13 of the cable 3 and a shielding element of the mating connector.

The second end of the shielding arrangement 9 is conventional in the sense that it is arranged to mate with a known connector. Thus, the shielding arrangement 9 defines a tubular portion arranged coaxially with the exposed portion of the contact pin 7 and is provided with a bayonet cap 15 for mechanically locking the connector to the mating connector. The structure of the bayonet cap 15 will be known to those skilled in the art.

It is the first end of the shielding arrangement 9 which is modified according to the invention. The first end of the shielding arrangement 9 defines an annular surface 17 for contacting the shielding 13 of the cable 1, and through the centre of which surface the central conductor 11 and dielectric layer 19 of the cable 3 may pass. The annular surface 17 defines a substantially "V" shaped annular groove. An inner wall of the groove is cylindrical and an outer wall of the groove is frusto-conical.

According to the invention, the connector 1 additionally comprises a spring arrangement 21 for resiliently urging the shielding 13 of the cable 1 against the annular surface 17 of the shielding arrangement 9. The spring arrangement 21 comprises a spring supporting means in the form of a spring retaining sleeve 23, a compression spring 25 and a collar 27.

The collar 27 of the spring arrangement 21 is arranged so that the central conductor 11 and dielectric layer 19 of the cable 3 may pass through its centre. A first end of the collar 27 defines an annular surface arranged to mate with the annular surface 17 of the shielding arrangement 9. Thus, the first end of the collar 27 defines an annular projection having cylindrical and frusto-conical surfaces. A second end of the collar 27 defines a flat surface arranged perpendicular to the axis of the connector 1 and against which the compression spring 25 may bear. The collar 27 is formed of a metallic material having a low electrical resistance.

The compression spring 25, which is a coil spring, has a diameter similar to that of the collar 27. Thus, a first end of the compression spring 25 may bear against the second end of the collar 27, and the central conductor 11 and dielectric layer 19 of the cable 3 may pass through its centre. A second end of the compression spring 25 is arranged such that it may be preloaded by the spring retaining sleeve 23, to thereby apply a resilient force to the collar 27.

The spring retaining sleeve 23 is arranged to receive the compression spring 25. A first end of the spring retaining sleeve 23 is provided with a pair of inwardly facing protrusions 31 for engagement with corresponding formations on the outer surface of the shielding arrangement 9. The formations on the shielding arrangement 9 comprise a raised band 33 having a pair of discontinuities of sufficient width for the inwardly facing protrusions 31 of the spring retaining sleeve 23 to pass. The raised band 33 is provided with notches between the discontinuities, in which notches the protrusions 31 of the spring retaining sleeve 23 may be maintained by the preload of the compression spring 25.

A second end of the spring retaining sleeve 23 is provided with inwardly formed flanges 29 which provide a bearing surface for the second end of the compression spring 25 and against which the compression spring 25 may be preloaded. The flanges 29 are sufficiently shallow to enable the central conductor 11 and dielectric layer 19 of the cable 3 to pass through the spring retaining sleeve 23.

In use, a cable 3 to be terminated with the connector 1 is prepared in the conventional manner. Thus, a portion of the outer cable insulation is removed from the end of the cable 3 to expose the shielding 13 and the dielectric layer 19 of the cable 3. A shorter portion of the dielectric layer 19 is also removed to expose the central conductor 11, and the exposed shielding 13 is flared slightly by pulling it away form the dielectric layer 19 and the central conductor 11.

To assemble the connector 1, the cable 3 is initially threaded through the spring arrangement 21 comprising the spring retaining sleeve 23, the compression spring 25 and the collar 27. The central conductor 11 of the cable 3 is then inserted into the contact pin 7 of the connector 1, which contact pin 7 has been preassembled with the spacing element 5 and the shielding arrangement 9.

As the cable 1 is directed towards the contact pin 7, the central conductor 11 and the dielectric layer 19 of the cable 3 are passed through the first end of the shielding arrangement 9, while the shielding 13 is gathered up and makes contact with the annular surface 17 of the shielding arrangement 9.

Once the centre conductor 11 of the cable 3 has been inserted into the contact pin 7 of the connector 1, the spring retaining sleeve 23 is pushed up the cable 3 and, against the force of the compression spring 25, is engaged with the shielding arrangement 9. In particular, the inwardly facing protrusions 31 on the spring retaining sleeve 23 are passed through the discontinuities in the raised band 33 formed on the shielding arrangement 9 and rotated until the protrusions 31 become seated in the notches in the raised band 33.

Once assembled, the compression spring provides sufficient force over the life of the connector to ensure a reliable electrical connection between the shielding arrangement and the shielding 13 of the cable 3, which shielding is trapped between the annular surface 17 of the shielding arrangement 9 and the collar 27. A reliable mechanical connection between the connector and the cable 3 is also provided.

A specific embodiment of the invention has been described above. Various changes may be made without departing from the invention. For example, the connector may have a plurality of contact pins for a respective plurality of central conductors of the cable. The coil spring could be replaced by another type of spring such as one or a plurality of stacked wave springs.

I claim:

1. A connector for a shielded electrical cable, the cable having at least one insulated central conductor surrounded by conductive shielding, the connector comprising:

a dielectric spacing element for receiving the at least one central conductor of the cable;

a conductive shielding arrangement provided around the spacing element and having an end which defines an annular surface for contacting the shielding of the cable, such that the at least one central conductor of the cable is surrounded by the annular surface of the conductive shielding arrangement, and a spring arrangement coupled to the shielding arrangement for resiliently urging the shielding of the cable against the annular surface of the shielding arrangement to thereby provide a reliable electrical connection between the cable and the shielding arrangement.

2. The connector of claim 1, wherein the annular surface of the shielding arrangement comprises a frusto-conical surface.

3. The connector of claim 2, wherein the annular surface of the shielding arrangement defines an annular groove.

4. The connector of claim 3, wherein the spring arrangement comprises a collar for contacting the annular surface of the shielding arrangement such that the shielding of the cable is trapped between the shielding arrangement and the collar.

5. The connector of claim 4, wherein the collar defines a frusto-conical surface arranged to engage with the frusto-conical surface of the shielding arrangement.

6. The connector of claim 5, wherein the collar defines an annular projection extending axially and arranged to engage with the annular groove of the shielding arrangement.

7. The connector of claim 1, wherein the spring arrangement comprises:

a collar for contacting the annular surface of the shielding arrangement such that the shielding of the cable is trapped between the shielding arrangement and the collar; and a compression spring for bearing against the collar.

8. The connector of claim 7, wherein the compression spring is a coil spring.

9. The connector of claim 7, wherein the spring arrangement further comprises a spring supporting means having a bearing surface for supporting one end of the compression spring such that the other end of the compression spring bears against the collar.

10. The connector of claim 9, wherein the spring supporting means is reversibly engagable with the shielding arrangement such that a positional relationship between the annular surface of the shielding arrangement and the bearing surface of the spring supporting means is fixable.

11. The connector of claim 10, wherein the spring supporting means comprises a sleeve arranged for receiving the compression spring.

12. The connector of claim 11, wherein the sleeve has inwardly formed flanges at one end defining the bearing surface and inwardly formed protrusions at the other end for engaging with cooperating formations on the outer surface of the shielding arrangement.

13. The connector of claim 12, wherein the cooperating formations on the outer surface of the shielding arrangement comprise a raised band having discontinuities of sufficient width to enable the inwardly formed protrusions of the sleeve to pass.

14. A cable arrangement comprising:

a shielded electrical cable having at least one insulated central conductor surrounded by conductive shielding; and a shielded electrical connector, the connector terminating the shielded electrical cable and comprising:

a dielectric spacing element for receiving the at least one central conductor of the cable;

a conductive shielding arrangement provided around the spacing element and having an end which defines an annular surface for contacting the shielding of the cable, such that the at least one central conductor of the cable is surrounded by the annular surface of the conductive shielding arrangement, and a spring arrangement coupled to the shielding arrangement for resiliently urging the shielding of the cable against the annular surface of the shielding arrangement to thereby provide a reliable electrical connection between the cable and the shielding arrangement.

* * * * *